United States Patent [19]

Sekiguchi et al.

[11] Patent Number: 4,561,999

[45] Date of Patent: Dec. 31, 1985

[54] SURFACTANT COMPOSITION

[75] Inventors: Shizuo Sekiguchi, Funabashi; Kyozo Kitano, Narashino; Katsumasa Nagano, Ichikawa, all of Japan

[73] Assignee: Lion Corporation, Tokyo, Japan

[21] Appl. No.: 608,680

[22] Filed: May 10, 1984

[30] Foreign Application Priority Data

May 10, 1983 [JP] Japan ..... 58-081569

[51] Int. Cl.[4] ..... C11D 1/12; C11D 1/28

[52] U.S. Cl. ..... 252/557; 252/536; 252/538; 252/554; 252/555; 252/DIG. 4

[58] Field of Search ..... 252/549, 554, 555, 536, 252/DIG. 4, 538, 557; 260/400

[56] References Cited

U.S. PATENT DOCUMENTS

| | | | |
|---|---|---|---|
| 1,667,225 | 4/1928 | Thauss et al. | 260/400 |
| 1,967,655 | 7/1934 | Bertsch | 260/400 |
| 2,336,387 | 12/1943 | Beckham | 260/400 |
| 2,844,606 | 7/1958 | Bistline et al. | 260/400 |
| 3,988,247 | 10/1976 | Dieckelmann | 260/400 |
| 4,259,204 | 3/1981 | Homma | 252/549 |

FOREIGN PATENT DOCUMENTS 1246717 8/1967 Fed. Rep. of Germany .

*Primary Examiner*—Prince E. Willis
*Assistant Examiner*—Hoa Van Le
*Attorney, Agent, or Firm*—Armstrong, Nikaido, Marmelstein & Kubovcik

[57] ABSTRACT

A surfactant composition comprising: (A) a sulfonic acid salt of a lower alkyl ester of a $C_8$ to $C_{22}$ saturated fatty acid; and (B) a sulfonic acid salt of a lower alkyl ester of a $C_8$ to $C_{22}$ unsaturated fatty acid, wherein the weight ratio (A/B) of the component (A) to the component (B) is 95/5 to 5/95.

This surfactant composition has improved rinsing properties without reduced detergency characteristics.

4 Claims, No Drawings

SURFACTANT COMPOSITION

BACKGROUND OF THE INVENTION

1. Field of the Invention

The present invention relates to a surfactant composition. More specifically, it relates to a surfactant composition in which the rinsing properties of a sulfonic acid salt of a lower alkyl ester of a saturated fatty acid are improved.

2. Description of the Prior Art

Sulfonic acid salts of lower alkyl esters of saturated fatty acids, i.e., alpha-sulfo fatty acid ester salts, are surfactants having excellent detergency (i.e., detergent power) and hard-water resistance. However, alpha-sulfo fatty acid ester salts have disadvantages in that vigorous foaming occurs at a low concentration and, therefore, the rinsing properties are poor when they are incorporated into household detergents such as laundry detergents and dish-washing detergents, when compared with other conventional surfactants such as alpha-olefin sulfonates, alkylbenzene sulfonates, or sulfates of higher alcohols.

As an improvement for the above-mentioned rinsing properties of alpha-sulfo fatty acid ester salts, Japanese Unexamined Patent Publication (Kokai) No. 53-97008 discloses the use of alpha-olefin sulfonates and sulfuric acid ester salts of alcohols combined with alpha-sulfo fatty acid ester salts. However, the rinsing properties of alpha-sulfo fatty acid ester salts were not satisfactorily improved as desired. Thus, it remains necessary that the above-mentioned disadvantages and problems of alpha-sulfo fatty acid ester salts should be fundamentally resolved.

It is known that the rinsing properties, that is, the foaming at a low concentration of the surfactant are closely correlated to a critical micelle concentration (CMC) of the surfactants. When the CMC is low, a large amount of foam is likely to be formed at a low surfactant concentration and the rinsing properties become poor. Conversely, the foaming becomes less at a low surfactant concentration and, therefore, the rinsing properties are improved, as the CMC increases. It is expected that the increase in the CMC of the surfactants can be achieved by decreasing the hydrophobic nature of a hydrophobic group of the surfactant molecule or by increasing the hydrophilic nature of a hydrophilic group. However, when the hydrophobic nature of a hydrophobic group of the surfactant molecule is decreased or the hydrophilic nature of a hydrophilic group of the surfactant molecule is increased, the characteristics of the surfactants affecting the detergency of the surfactants such as foaming power, penetrating power, and solubilizing power, are decreased. Accordingly, there is a need in the art for increasing the CMC of the surfactants, and improving the rinsing properties of the surfactants, without decreasing the characteristics required of detergents.

SUMMARY OF THE INVENTION

Accordingly, the objects of the present invention are to eliminate the above-mentioned problems of the prior art and to provide a surfactant composition containing a sulfonic acid salt of a lower alkyl ester of a saturated fatty acid and having remarkably improved rinsing properties without reduced detergency characteristics.

Other objects and advantages of the present invention will be apparent from the following description.

In accordance with the present invention, there is provided a surfactant composition comprising: (A) a sulfonic acid salt of a lower alkyl ester of a $C_8$ to $C_{22}$ saturated fatty acid; and (B) a sulfonic acid salt of a lower alkyl ester of a $C_8$ to $C_{22}$ unsaturated fatty acid, wherein the weight ratio (A/B) of the component (A) to the component (B) is 95/5 to 5/95.

DESCRIPTION OF THE PREFERRED EMBODIMENTS

The component (A) used in the present invention is selected from sulfonic acid salts of lower alkyl esters of $C_8$ to $C_{22}$ saturated fatty acids, preferably those having lower alkyl groups with 1 to 6 carbon atoms. Of these sulfonic acid salts, those having fatty acid residues with 12 to 18 carbon atoms and lower alkyl groups with 1 to 3 carbon atoms are more preferably used in the present invention.

The component (B) used in the present invention is selected from sulfonic acid salts of lower alkyl esters of $C_8$ to $C_{22}$ unsaturated fatty acids, preferably those having lower alkyl groups with 1 to 6 carbon atoms. Of these sulfonic acid salts, those having fatty acid residues with 12 to 18 carbon atoms and lower alkyl groups with 1 to 3 carbon atoms are more preferably used in the present invention.

Typical structures of the component (B) are as follows.

Alkenyl monosulfonates

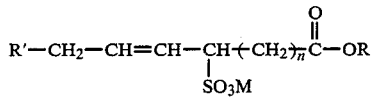

Alkenyl disulfonates

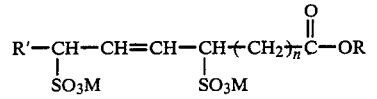

Hydroxy monosulfonates

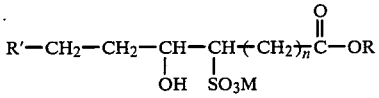

wherein R and R′ are independently alkyl or alkenyl groups, preferably those having 1 to 17 carbon atoms, M is a cationic ion, preferably an alkali metal such as sodium, potassium, and lithium, an alkaline earth metal such as barium and magnesium, ammonium, and organic amine such as monoethanol amine, diethanol amine, and triethanol amine, and n is an integer of 0 to 15.

Since the component (B) is a salt of a sulfonate of a lower alkyl ester of an unsaturated fatty acid, sulfonates containing no double bond such as the above-mentioned hydroxy monosulfonates can be used as the component (B) because they function in the same manner as the unsaturated alkenyl monosulfonates. However, the sulfonic acid salts of the unsaturated fatty acid esters of the component (B) preferably contain 50% by weight or more of a sulfonic acid salt of an unsaturated fatty acid ester having a double bond in view of the characteristics, particularly detergency, of the surfactants.

As mentioned above, the sulfonic acid salts of the component (B) may include monosulfonic acid salts substituted with one sulfonic group and polysulfonic acid salts substituted with two or more sulfonic groups such as disulfonic acid salts, but the weight ratio of the monosulfonic acid salts to the polysulfonic acid salts is preferably 97/3 to 10/90, more preferably 90/10 to 30/70. When the ratio of the monosulfonic acid salts to the polysulfonic acid salts is more than 97/3, the rinsing properties of the surfactants are not likely to be desirably improved. When the above ratio is less than 10/90, the detergent characteristics such as the foaming power, penetrating power, and solubilizing power during washing are likely to be undesirably decreased.

The weight ratio (A/B) of the component (A) to the component (B) in the present surfactant mixture composition should be 95/5 to 5/95, preferably 80/20 to 20/80, and more desirably 60/40 to 40/60. The desired improvements in the detergency, solubilizing properties, and rinsing properties can be achieved only when the components (A) and (B) are used together in the weight ratio of (A)/(B)=95/5 to 5/95.

The surfactant composition according to the present invention can be prepared either by mixing the starting saturated fatty acid alkyl esters and the starting unsaturated fatty acid alkyl esters after the sulfonation or by first mixing the starting saturated and unsaturated fatty acid alkyl esters, followed by the sulfonation. Furthermore, unhardened or partially hardened products obtained during the purification processes of fatty acids or their salts from natural fats and oils can be effectively used as the starting mixtures.

The sulfonation can be carried out by using, for example, a thin-film type sulfonation method or vessel type sulfonation method. As a sulfonating agent, any conventional sulfonating agent such as liquid $SO_3$, gaseous $SO_3$, oleum, or chlorosulfonic acid can be used. The sulfonated products are then neutralized in any conventional manner by an alkaline agent to form the desired sulfonic acid salts. The salts of both the components (A) and (B) can be the alkali metal salts (e.g., Na, K, and Li), alkaline earth salts (e.g., Mg and Ba), ammonium salts, and organic base salts (e.g., amine salts).

When the surfactant compositions according to the present invention are used as detergent compositions, other conventional ingredients for detergents such as inorganic builders (e.g., sodium sulfate, tripolyphosphate, sodium bicarbonate, alumino silicate, and potassium pyrophosphate), organic builders (e.g., sodium citrate, carboxymethyl cellulose, methyl cellulose, sodium polymaleate, and sodium polyacrylate), chelating agents (e.g., sodium nitrile triacetate and EDTA ), fluorescent brightening agents, and perfumes.

According to the present invention, a surfactant composition having a large solubility, excellent detergency characteristics, and excellent rinsing properties can be obtained by compounding the above-mentioned components (A) and (B) in the specified ratio.

EXAMPLES

The present invention now will be further illustrated by, but is by no means limited to, the following examples.

EXAMPLE 1

A 296 g (1 mole) amount of methyl oleate was charged into a 1 liter four-necked glass flask. The flask was heated to a temperature of 80° C. A 240 g (3 moles) amount of $SO_3$ diluted with nitrogen gas to 5% by volume was then introduced into the flask over 120 minutes while stirring to prepare a sulfonated mixture. A 80.4 g (15% based on the sulfonated mixture) amount of methanol and 30.6 g (2% in terms of $H_2O_2$ based on the sulfonated mixture) of 35% hydrogen peroxide were added to the sulfonated mixture obtained above. Thus, the sulfonated mixture was bleached at a temperature of 80° C. for 60 minutes. The resultant mixture was neutralized by a 10% aqueous sodium hydroxide solution. The mixture was heated at a temperature of 95° C. to 100° C. for 2 hours to thermally decompose sultone. Thus, sodium sulfonate of methyl oleate was obtained. The ratio of the monosulfonate to the polysulfonate determined by an electrophoretic ion determination apparatus was 30/70.

On the other hand, methyl stearate having an iodine value of 0.02 was sulfonated, bleached, and neutralized in the same manner as described above. Thus, sodium sulfonate of methyl stearate (i.e., sodium alpha-sulfo stearate) was obtained.

The sodium sulfonate of methyl oleate (i.e., component B) and the sodium sulfonate of methyl stearate (i.e., component A) obtained above were mixed together in the ratio listed in Table 1. The CMC, foaming property, penetrating power, and solubilizing capability of the resultant surfactant mixture, the foaming degree at an ordinary washing concentration, the surfactant concentration at which a foaming height becomes zero, and the solubility of the surfactant mixture were determined as follows:

Solubilizing capability: a yellow-OB solubilizing method, at 40° C. for 48 hours.

CMC: A yellow-OB method at 40° C.

Penetrating power: A canvas disc method (1 cm square), at a concentration of 10 mM/liter at 40° C.

Foaming property: Foaming height was determined by a Ross & Miles method at 40° C.

Solubility: Crystal precipitation temperature was determined at a temperature decreasing rate of 1° C./min in a 1% aqueous ethyleneglycol solution (ethylene glycol/water=1/1).

TABLE 1

| | Run No. | 1*1 | 2 | 3 | 4 | 5*1 |
|---|---|---|---|---|---|---|
| | Component B/Component A | 100/0 | 80/20 | 50/50 | 30/70 | 0/100 |
| Characteristics | CMC (m mole/l) | 3.0 | 1.2 | 1.0 | 0.8 | 0.1 |
| | Foaming height (mm) | 20 | 85 | 135 | 135 | 110 |
| | Penetrating power (1/sec) | 0.18 | 0.15 | 0.10 | 0.07 | 0.04 |
| | Solubilizing capability (mole/mole × $10^2$) | 2.5 | 3.9 | 4.1 | 4.4 | 4.5 |
| Solubility | Crystallization temp. (°C.) | less than −20° C. | −10° C. | 0 to −5° C. | 5 to 10° C. | 18 to 20° C. |
| Rinsing property | Surfactant concentration at which foaming height | 0.1 | 0.05 | 0.01 | 0.008 | 0.0005 |

TABLE 1-continued

| Run No. | 1*[1] | 2 | 3 | 4 | 5*[1] |
|---|---|---|---|---|---|
| Component B/Component A | 100/0 | 80/20 | 50/50 | 30/70 | 0/100 |
| become zero (m mole/l) | | | | | |

*[1]Comparative example

EXAMPLE 2

The rinsing properties of the mixture of the sulfonate of methyl stearate and the sulfonate of methyl oleate prepared in Example 1 were evaluated in a commercially available washing machine.

The test conditions were as follows:

Amount of detergent: 40 g/Water 30 liters.

Water temperature: 25° C.

Washed articles: Eight naturally soiled cotton shirts.

TABLE 2

| Run No. | | 1 | 2*[1] |
|---|---|---|---|
| Detergent composition | Sulfonate of methyl stearate | 10 wt % | 20 wt % |
| | Sulfonate of methyl oleate | 10 wt % | 0 |
| | Sodium sulfate | balance | balance |
| Foam height during washing (mm) | | 15–20 | 15–20 |
| Rinsing properties | First time | Foam height of 2–3 mm (Entire surface) | Foam height of 5–10 mm (Entire surface) |
| | Second time | Foam height of less than 1 mm (Partially) | Foam height of 3–5 mm (Entire Surface) |
| | Third time | No substantial foam residue | Foam height of 1–3 mm (Entire surface) |

*[1]Comparative example

We claim:

1. A surfactant composition consisting essentially of:

(A) a sulfonic acid salt of a lower alkyl ester of a $C_8$ to $C_{22}$ saturated fatty acid; and (B) a sulfonic acid salt of a lower alkyl ester of a $C_8$ to $C_{22}$ unsaturated fatty acid, wherein the weight ratio (A/B) of the component (A) to the component (B) is 80/20 to 20/80.

2. A surfactant composition as claimed in claim 1, wherein 50% by weight or more of the component (B) is a sulfonic acid salt of a lower alkyl ester of a $C_8$ to $C_{22}$ unsaturated fatty acid having a double bond in the molecule thereof.

3. A surfactant composition as claimed in claim 1, wherein the weight ratio of a monosulfonic acid salt to a polysulfonic acid salt in the sulfonic acid salt of the lower alkyl ester of the $C_8$ to $C_{22}$ unsaturatd fatty acid of the component (B) is 97/3 to 10/90.

4. A surfactant composition as claimed in claim 1, wherein the lower alkyl groups in the lower alkyl esters of the components (A) and (B) are those having 1 to 6 carbon atoms.

* * * * *